US009160144B2

(12) United States Patent
Yoshida et al.

(10) Patent No.: US 9,160,144 B2
(45) Date of Patent: Oct. 13, 2015

(54) SPARK PLUG WITH INTERNAL RESISTOR HAVING TI AND ZR COMPONENTS

(71) Applicant: NGK Spark Plug Co., Ltd., Nagoya-shi, Aichi (JP)

(72) Inventors: Haruki Yoshida, Gifu-ken (JP); Toshitaka Honda, Aichi-ken (JP)

(73) Assignee: NGK Spark Plug Co., Ltd., Nagoya-Shi, Aichi (JP)

( * ) Notice: Subject to any disclaimer, the term of this patent is extended or adjusted under 35 U.S.C. 154(b) by 6 days.

(21) Appl. No.: 14/038,925

(22) Filed: Sep. 27, 2013

(65) Prior Publication Data

US 2014/0091700 A1 Apr. 3, 2014

(30) Foreign Application Priority Data

Oct. 2, 2012 (JP) ..... 2012-220050

(51) Int. Cl.

| | |
|---|---|
| ***H01T 13/02*** | (2006.01) |
| ***H01T 13/05*** | (2006.01) |
| ***H01T 13/39*** | (2006.01) |
| ***H01T 13/41*** | (2006.01) |

(52) U.S. Cl.

CPC ..... *H01T 13/02* (2013.01); *H01T 13/05* (2013.01); *H01T 13/39* (2013.01); *H01T 13/41* (2013.01)

(58) Field of Classification Search

CPC ..... H01C 8/00; H01T 13/41
USPC ..... 313/118–145; 123/169 R, 169 EL, 32, 123/41, 310

See application file for complete search history.

(56) References Cited

U.S. PATENT DOCUMENTS

| | | | | |
|---|---|---|---|---|
| 6,160,342 | A | 12/2000 | Nishikawa et al. | 313/141 |
| 6,334,800 | B1 * | 1/2002 | Nishikawa et al. | 445/7 |
| 2011/0133626 | A1 * | 6/2011 | Shibata et al. | 313/141 |
| 2011/0204766 | A1 | 8/2011 | Yoshida et al. | 313/141 |

FOREIGN PATENT DOCUMENTS

| | | | |
|---|---|---|---|
| EP | 2 348 589 | 7/2011 | H01T 13/20 |
| JP | 2005-327743 | 11/2005 | H01T 13/20 |
| WO | WO 2010/052875 | 5/2010 | H01T 13/20 |

* cited by examiner

*Primary Examiner* — Nimeshkumar Patel
*Assistant Examiner* — Jacob R Stern
(74) *Attorney, Agent, or Firm* — Kusner & Jaffe

(57) ABSTRACT

A spark plug with both improved load life performance and improved radio-noise-preventing property, wherein the spark plug has a resistor containing a Ti component. The spark plug includes a circular columnar insulator having a through hole; a center electrode; a terminal shell; and a resistor provided in the through hole and between the terminal shell and the center electrode. The resistor contains glass, a Ti component, a Zr component, and a non-metallic electrically conductive material.

5 Claims, 9 Drawing Sheets

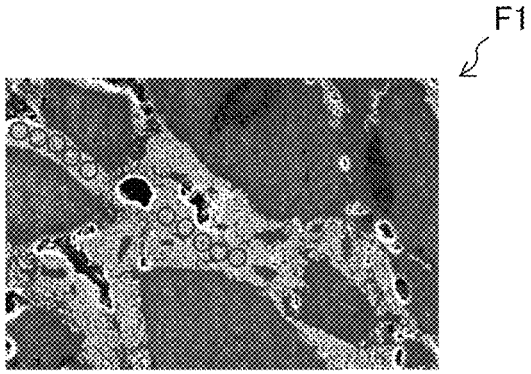
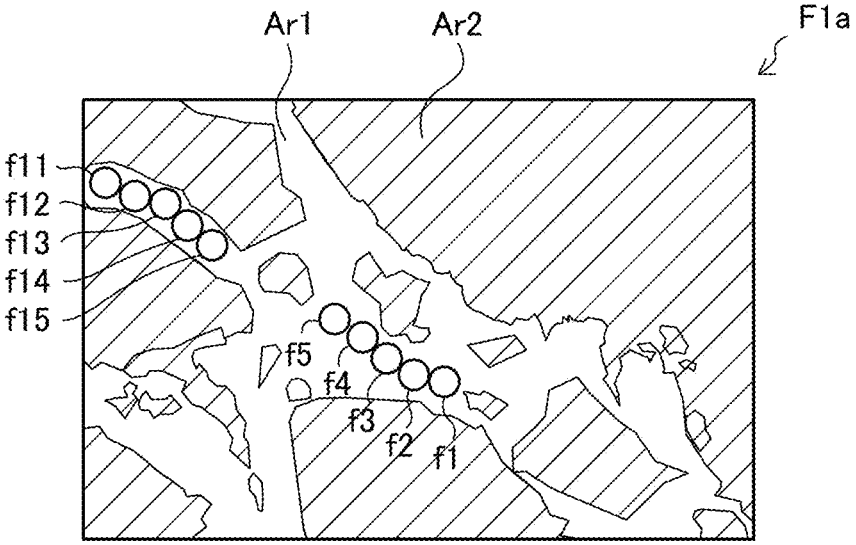
FIG. 4

Table 1

| Sample No. | EPMA analysis results | | Raw material particle size | | | Sealing diameter (mm) | Dispersion state | Load life performance (score) | Radio-noise-preventing property (score) | Comprehensive evaluation (score) |
|---|---|---|---|---|---|---|---|---|---|---|
| | Zr content (wt.%) | Ti content (wt.%) | $TiO_2$ mean particle size (μm) | $ZrO_2$ mean particle size (μm) | Amount of $TiO_2$ having a mean particle size of 1 μm or less (wt.%) | | | | | |
| 1 | 18 | 0.2 | 0.6 | 2.0 | 0.04 | 3.2 | O | 3 | 10 | 3 |
| 2 | 16 | 0.5 | 0.6 | 2.0 | 0.10 | 3.2 | O | 8 | 10 | 8 |
| 3 | 18 | 1 | 0.6 | 2.0 | 0.20 | 3.2 | O | 10 | 10 | 10 |
| 4 | 20 | 2 | 0.6 | 2.0 | 0.40 | 3.2 | O | 10 | 10 | 10 |
| 5 | 25 | 5 | 0.6 | 2.0 | 1.00 | 3.2 | O | 10 | 10 | 10 |
| 6 | 18 | 8 | 0.6 | 2.0 | 1.60 | 3.2 | O | 10 | 10 | 10 |
| 7 | 17 | 10 | 0.6 | 2.0 | 2.00 | 3.2 | O | 10 | 10 | 10 |
| 8 | 18 | 12 | 0.6 | 2.0 | 2.40 | 3.2 | O | 10 | 9 | 9 |
| 9 | 15 | 15 | 0.6 | 2.0 | 3.00 | 3.2 | O | 10 | 8 | 8 |
| 10 | 15 | 18 | 0.6 | 2.0 | 3.60 | 3.2 | O | 10 | 1 | 1 |

FIG. 5

Table 2

| Sample No. | EPMA analysis results | | Raw material particle size | | | Sealing diameter (mm) | Dispersion state | Load life performance (score) | Radio-noise-preventing property (score) | Comprehensive evaluation (score) |
|---|---|---|---|---|---|---|---|---|---|---|
| | Zr content (wt.%) | Ti content (wt.%) | $TiO_2$ mean particle size (μm) | $ZrO_2$ mean particle size (μm) | Amount of $TiO_2$ having a mean particle size of 1 μm or less (wt.%) | | | | | |
| 58 | 25 | 5 | 0.6 | 2.0 | 1.00 | 3.2 | X | 1 | 10 | 1 |
| 59 | 15 | 15 | 0.6 | 2.0 | 3.00 | 3.2 | X | 1 | 8 | 1 |
| 60 | 15 | 18 | 0.6 | 2.0 | 3.60 | 3.2 | X | 5 | 1 | 1 |

FIG. 6

Table 3

| Sample No. | EPMA analysis results | | Raw material particle size | | | Sealing diameter (mm) | Dispersion state | Load life performance (score) | Radio-noise-preventing property (score) | Comprehensive evaluation (score) |
|---|---|---|---|---|---|---|---|---|---|---|
| | Zr content (wt.%) | Ti content (wt.%) | $TiO_2$ mean particle size (μm) | $ZrO_2$ mean particle size (μm) | Amount of $TiO_2$ having a mean particle size of 1 μm or less (wt.%) | | | | | |
| 11 | 18 | 8 | 2.0 | 1.5 | 0.50 | 3.2 | O | 6 | 10 | 6 |
| 12 | 21 | 8 | 2.5 | 1.5 | 0.50 | 3.2 | O | 6 | 10 | 6 |
| 13 | 18 | 8 | 4.0 | 4.5 | 0.70 | 3.2 | O | 10 | 10 | 10 |
| 14 | 15 | 8 | 2.5 | 2.5 | 0.40 | 3.2 | O | 6 | 10 | 6 |
| 15 | 17 | 8 | 0.3 | 6.0 | 0.60 | 3.2 | O | 10 | 10 | 10 |
| 16 | 15 | 8 | 0.6 | 0.8 | 1.60 | 3.2 | O | 10 | 10 | 10 |
| 17 | 25 | 8 | 0.6 | 1.5 | 1.60 | 3.2 | O | 10 | 10 | 10 |

FIG. 7

Table 4

| Sample No. | EPMA analysis results | | Raw material particle size | | | Sealing diameter (mm) | Dispersion state | Load life performance (score) | Radio-noise-preventing property (score) | Comprehensive evaluation (score) |
|---|---|---|---|---|---|---|---|---|---|---|
| | Zr content (wt.%) | Ti content (wt.%) | $TiO_2$ mean particle size (μm) | $ZrO_2$ mean particle size (μm) | Amount of $TiO_2$ having a mean particle size of 1 μm or less (wt.%) | | | | | |
| 18 | 38 | 0.2 | 0.6 | 2.0 | 0.04 | 2.5 | O | 1 | 10 | 1 |
| 19 | 40 | 0.5 | 0.6 | 2.0 | 0.10 | 2.5 | O | 8 | 10 | 8 |
| 20 | 18 | 1 | 0.6 | 2.0 | 0.20 | 2.5 | O | 10 | 10 | 10 |
| 21 | 26 | 5 | 0.6 | 2.0 | 1.00 | 2.5 | O | 10 | 10 | 10 |
| 22 | 18 | 10 | 0.6 | 2.0 | 2.00 | 2.5 | O | 10 | 10 | 10 |
| 23 | 19 | 12 | 0.6 | 2.0 | 2.40 | 2.5 | O | 10 | 9 | 9 |
| 24 | 15 | 15 | 0.6 | 2.0 | 3.00 | 2.5 | O | 10 | 8 | 8 |
| 25 | 18 | 18 | 0.6 | 2.0 | 3.60 | 2.5 | O | 10 | 1 | 1 |
| 26 | 24 | 0.2 | 0.6 | 2.0 | 0.04 | 2.9 | O | 1 | 10 | 1 |
| 27 | 27 | 0.5 | 0.6 | 2.0 | 0.10 | 2.9 | O | 8 | 10 | 8 |
| 28 | 19 | 1 | 0.6 | 2.0 | 0.20 | 2.9 | O | 10 | 10 | 10 |
| 29 | 22 | 5 | 0.6 | 2.0 | 1.00 | 2.9 | O | 10 | 10 | 10 |
| 30 | 18 | 10 | 0.6 | 2.0 | 2.00 | 2.9 | O | 10 | 10 | 10 |
| 31 | 29 | 12 | 0.6 | 2.0 | 2.40 | 2.9 | O | 10 | 9 | 9 |
| 32 | 18 | 15 | 0.6 | 2.0 | 3.00 | 2.9 | O | 10 | 8 | 8 |
| 33 | 18 | 18 | 0.6 | 2.0 | 3.60 | 2.9 | O | 10 | 1 | 1 |
| 34 | 22 | 0.2 | 0.6 | 2.0 | 0.04 | 3.5 | O | 3 | 10 | 3 |
| 35 | 19 | 0.5 | 0.6 | 2.0 | 0.10 | 3.5 | O | 8 | 10 | 8 |
| 36 | 25 | 1 | 0.6 | 2.0 | 0.20 | 3.5 | O | 10 | 10 | 10 |
| 37 | 12 | 5 | 0.6 | 2.0 | 1.00 | 3.5 | O | 10 | 10 | 10 |
| 38 | 10 | 10 | 0.6 | 2.0 | 2.00 | 3.5 | O | 10 | 10 | 10 |
| 39 | 16 | 12 | 0.6 | 2.0 | 2.40 | 3.5 | O | 10 | 9 | 9 |
| 40 | 18 | 15 | 0.6 | 2.0 | 3.00 | 3.5 | O | 10 | 8 | 8 |
| 41 | 16 | 18 | 0.6 | 2.0 | 3.60 | 3.5 | O | 10 | 1 | 1 |
| 42 | 22 | 0.2 | 0.6 | 2.0 | 0.04 | 4 | O | 4 | 10 | 4 |
| 43 | 18 | 0.5 | 0.6 | 2.0 | 0.10 | 4 | O | 8 | 10 | 8 |
| 44 | 25 | 1 | 0.6 | 2.0 | 0.20 | 4 | O | 10 | 10 | 10 |
| 45 | 23 | 5 | 0.6 | 2.0 | 1.00 | 4 | O | 10 | 10 | 10 |
| 46 | 20 | 10 | 0.6 | 2.0 | 2.00 | 4 | O | 10 | 10 | 10 |
| 47 | 30 | 12 | 0.6 | 2.0 | 2.40 | 4 | O | 10 | 9 | 9 |
| 48 | 15 | 15 | 0.6 | 2.0 | 3.00 | 4 | O | 10 | 8 | 8 |
| 49 | 22 | 18 | 0.6 | 2.0 | 3.60 | 4 | O | 10 | 1 | 1 |

FIG. 8

Table 5

| Sample No. | EPMA analysis results | | Raw material particle size | | | Sealing diameter (mm) | Dispersion state | Load life performance (score) | Radio-noise-preventing property (score) | Comprehensive evaluation (score) |
|---|---|---|---|---|---|---|---|---|---|---|
| | Zr content (wt.%) | Ti content (wt.%) | $TiO_2$ mean particle size (μm) | $ZrO_2$ mean particle size (μm) | Amount of $TiO_2$ having a mean particle size of 1 μm or less (wt.%) | | | | | |
| 50 | 29 | 5 | 1.0 | 30.0 | 0.05 | 3.2 | O | 9 | 10 | 9 |
| 51 | 28 | 5 | 0.9 | 30.0 | 0.10 | 3.2 | O | 10 | 10 | 10 |
| 52 | 19 | 5 | 0.8 | 30.0 | 0.50 | 3.2 | O | 10 | 10 | 10 |
| 53 | 37 | 5 | 0.5 | 30.0 | 2.20 | 3.2 | O | 10 | 10 | 10 |
| 54 | 27 | 5 | 0.4 | 30.0 | 2.50 | 3.2 | O | 10 | 10 | 10 |
| 55 | 22 | 5 | 0.3 | 30.0 | 3.00 | 3.2 | O | 10 | 10 | 10 |
| 56 | 25 | 5 | 0.2 | 30.0 | 4.00 | 3.2 | O | 10 | 10 | 10 |
| 57 | 18 | 5 | 0.1 | 30.0 | 4.50 | 3.2 | O | 9 | 10 | 9 |

FIG. 9

SPARK PLUG WITH INTERNAL RESISTOR HAVING TI AND ZR COMPONENTS

FIELD OF THE INVENTION

The present invention relates to a spark plug.

BACKGROUND OF THE INVENTION

There has been widely used a spark plug including a center electrode, a terminal shell, and a resistor which is provided between the center electrode and the terminal shell for improving the property of preventing generation of radio noise (hereinafter may be referred to as "radio-noise-preventing property"). In such a spark plug including a resistor, a non-metallic electrically conductive material (e.g., carbon) contained in the resistor may be lost through oxidation by electric energy flowing through the resistor, whereby electric resistance may increase, resulting in deterioration of ignition performance (load life performance). Thus, there has been proposed a technique for suppressing an increase in electrical resistance and improving load life performance by incorporating, into a resistor, a Ti (titanium) component such as Ti particles or Ti suboxide particles. See Japanese Patent Application Laid-Open (kokai) No. 2005-327743 (Patent Document 1).

In the case of such a conventional technique (i.e., incorporation of a Ti component into a resistor), when the amount of the Ti component incorporated is large, electric resistance may be greatly reduced during ignition, resulting in deterioration of radio-noise-preventing property. Meanwhile, when the amount of the Ti component incorporated is small, a problem may arise in that load life performance is deteriorated. Thus, the conventional technique (i.e., incorporation of a Ti component into a resistor) is insufficient for improving both load life performance and radio-noise-preventing property; i.e., the conventional technique still has room for improvement.

SUMMARY OF THE INVENTION

The present invention has been accomplished for solving the aforementioned problems, and the invention provides the following modes.

(1) In one mode of the present invention, there is provided a spark plug comprising a circular columnar insulator having a through hole extending in an axial direction; a center electrode fixed in the through hole of the insulator; a terminal shell fixed in the through hole of the insulator; and a resistor which is provided in the through hole and between the terminal shell and the center electrode, and which contains glass, a Ti component, a Zr component, and a non-metallic electrically conductive material, the spark plug being characterized in that, in a cross section of a conduction path portion of the resistor, the conduction path portion containing the Zr component and the Ti component, the average of the Ti component contents by weight of five continuous circular regions, each region having a diameter of 20 μm, is 0.5 wt. % to 15 wt. %; and, when A represents the average of the Ti component contents by weight of any 30 circular regions, each region having a diameter of 20 μm, in the conduction path portion, and when B represents the Ti component content by weight of each of the 30 circular regions, the total of the number of circular regions in which B is less than 0.25 times A and the number of circular regions in which B is greater than 3.0 times A is 2 or less. According to the spark plug of this mode, since the Ti component is sufficiently dispersed in the conduction path portion, current readily flows through the Ti component in the conduction path portion, and thus the amount of current flowing through the non-metallic electrically conductive material can be suppressed. Therefore, even when contact resistance is high due to the presence of the Zr component around the non-metallic electrically conductive material, since the amount of current flowing through the non-metallic electrically conductive material is suppressed, removal of the non-metallic electrically conductive material, which would otherwise be caused by contact resistance, can be prevented. Thus, an increase in electric resistance can be suppressed in the resistor, to thereby improve load life performance. In addition, since the average of the Ti component contents by weight is 0.5 wt. % to 15 wt. %, an increase in electric resistance in the resistor, which would otherwise be caused by an excessive amount of the Ti component, can be suppressed, and radio-noise-preventing property can be improved.

(2) In the spark plug of the aforementioned mode, the Zr component content by weight of the conduction path portion may be 10 wt. % to 40 wt. %. In this case, since an appropriate amount of the Zr component is contained in the conduction path portion, the dispersibility of the non-metallic electrically conductive material present around the Zr component can be enhanced. Therefore, a large amount of the non-metallic electrically conductive material can be caused to be present around the Ti component in the conduction path portion, and thus removal of the non-metallic electrically conductive material can be prevented.

(3) In the spark plug of the aforementioned mode, the Ti component content by weight may be 1.0 wt. % to 12 wt. %. In this case, since an appropriate amount of the Ti component is contained in the conduction path portion, both load life performance and radio-noise-preventing property can be improved.

(4) In the spark plug of the aforementioned mode, a portion of the through hole where the resistor is provided may have a minimum diameter of 3.5 mm or less. In this case, the hardness of the precursor of the resistor (which would otherwise be more difficult to compress during production of the resistor, as compared with the case of a spark plug including a resistor having a minimum diameter of more than 3.5 mm) can be appropriately adjusted, since an appropriate amount of the Ti component is dispersed in the precursor of the resistor. Therefore, since the precursor of the resistor can be readily compressed, the density of the precursor can be enhanced, and the amount of the non-metallic electrically conductive material around which the Ti component is present can be increased.

(5) In the spark plug of the aforementioned mode, a portion of the through hole where the resistor is provided may have a minimum diameter of 2.9 mm or less. In this case, the precursor of the resistor of the spark plug can be readily compressed, although, generally, a resistor having a smaller diameter is more difficult to form through compression of a resistor precursor.

(6) In the spark plug of the aforementioned mode, the resistor is produced from at least $TiO_2$ particles and $ZrO_2$ particles, and the $TiO_2$ particles may have a mean particle size smaller by 0.2 μm or more than that of the $ZrO_2$ particles. In this case, since the mean particle size of the $TiO_2$ particles is smaller by 0.2 μm or more than that of the $ZrO_2$ particles, the dispersibility of $TiO_2$ grains relative to the non-metallic electrically conductive material, which is present around $ZrO_2$ grains, can be enhanced, and thus the amount of the non-metallic electrically conductive material around which the $TiO_2$ grains are present can be increased.

(7) In the spark plug of the aforementioned mode, in a material of the resistor, the amount by weight of $TiO_2$ particles having a particle size of 1 μm or less may be 0.1 wt. % to 4.0 wt. %. In this case, an appropriate number of $TiO_2$ grains can be incorporated in the conduction path portion. When the number of $TiO_2$ grains contained in the conduction path portion is small, the amount of the non-metallic electrically conductive material around which no $TiO_2$ grains are present is increased, and removal of the non-metallic electrically conductive material is likely to occur. Meanwhile, when the number of $TiO_2$ grains having a grain size of 1 μm or less and contained in the conduction path portion is large, $TiO_2$ grains having a relatively small grain size are aggregated, and the dispersibility of the $TiO_2$ grains is lowered. In contrast, in the aforementioned case, an appropriate number of $TiO_2$ grains can be incorporated, and the amount of the non-metallic electrically conductive material around which the $TiO_2$ grains are present can be increased.

The present invention may be implemented in various forms other than a spark plug. For example, the present invention may be implemented as an internal combustion engine including a spark plug, a vehicle including the internal combustion engine, etc. Alternatively, the present invention may be implemented as a spark plug production method.

BRIEF DESCRIPTION OF THE DRAWINGS

FIG. 4 is an explanatory view of an example of a sample employed for Zr or Ti content determination by means of electron probe micro analyzer (EPMA).

FIG. 5 is a Table 1 showing the results of measurement and evaluation of the respective spark plugs 100 of Example 1.

FIG. 6 is a Table 2 showing the results of measurement and evaluation of spark plugs of Comparative Example.

FIG. 7 is a Table 3 showing the results of measurement and evaluation of the spark plugs 100 of Example 2.

FIG. 8 is a Table 4 showing the results of measurement and evaluation of the spark plugs 100 of Example 3.

FIG. 9 is a Table 5 showing the results of measurement and evaluation of the spark plugs 100 of Example 4.

DETAILED DESCRIPTION OF THE INVENTION

A. Embodiment

A1. Configuration of Spark Plug

Figure 1:
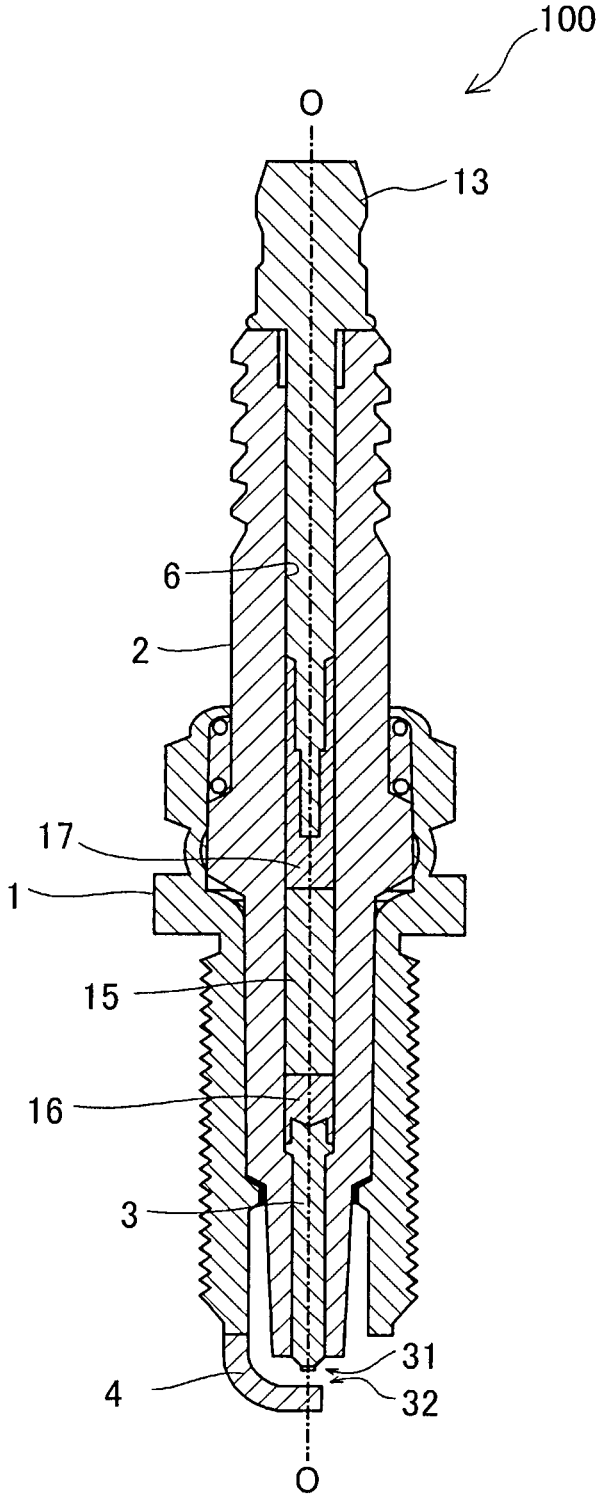
FIG. 1 is a cross-sectional view of the structure of a main portion of a spark plug according to one embodiment of the present invention.

FIG. 1 is a cross-sectional view of the structure of a main portion of a spark plug according to one embodiment of the present invention. The spark plug 100 includes a metallic shell 1, an insulator 2, a center electrode 3, a ground electrode 4, and a terminal shell 13. The metallic shell 1 is formed of a metal material such as carbon steel, and has a hollow circular columnar shape. The metallic shell 1 serves as a housing of the spark plug 100.

The insulator 2 is formed of a ceramic sintered compact, and has a through hole 6 extending along an axis O. The center electrode 3, the terminal shell 13, etc. are fitted into the through hole 6. A portion of the terminal shell 13 is inserted and fixed in the through hole 6 on one end side thereof, and the center electrode 3 is inserted and fixed in the through hole 6 on the other end side thereof. In the through hole 6, a resistor 15 is provided between the terminal shell 13 and the center electrode 3. Both ends of the resistor 15 are electrically connected to the center electrode 3 and the terminal shell 13 via electrically conductive glass sealing layers 16 and 17, respectively.

The resistor 15 functions as an electrical resistor between the terminal shell 13 and the center electrode 3, to thereby suppress generation of radio noise during spark discharge. The resistor 15 is formed of ceramic powder, an electrically conductive material, metal powder, glass, and a binder (adhesive). In the present embodiment, both load life performance and radio-noise-preventing property can be improved by producing the resistor 15 through the below-described procedure.

The center electrode 3 has, on its forward end, an ignition portion 31, and the center electrode 3 is provided in the through hole 6 such that the ignition portion 31 is exposed to the outside. One end of the ground electrode 4 is welded to the metallic shell 1. The other end portion of the ground electrode 4 is bent toward the center electrode 3 such that a side surface 32 of the ground electrode 4 faces the ignition portion 31 of the center electrode 3. The gap between the side surface 32 and the ignition portion 31 serves as a spark discharge gap.

A2. Production of Spark Plug

Figure 2:
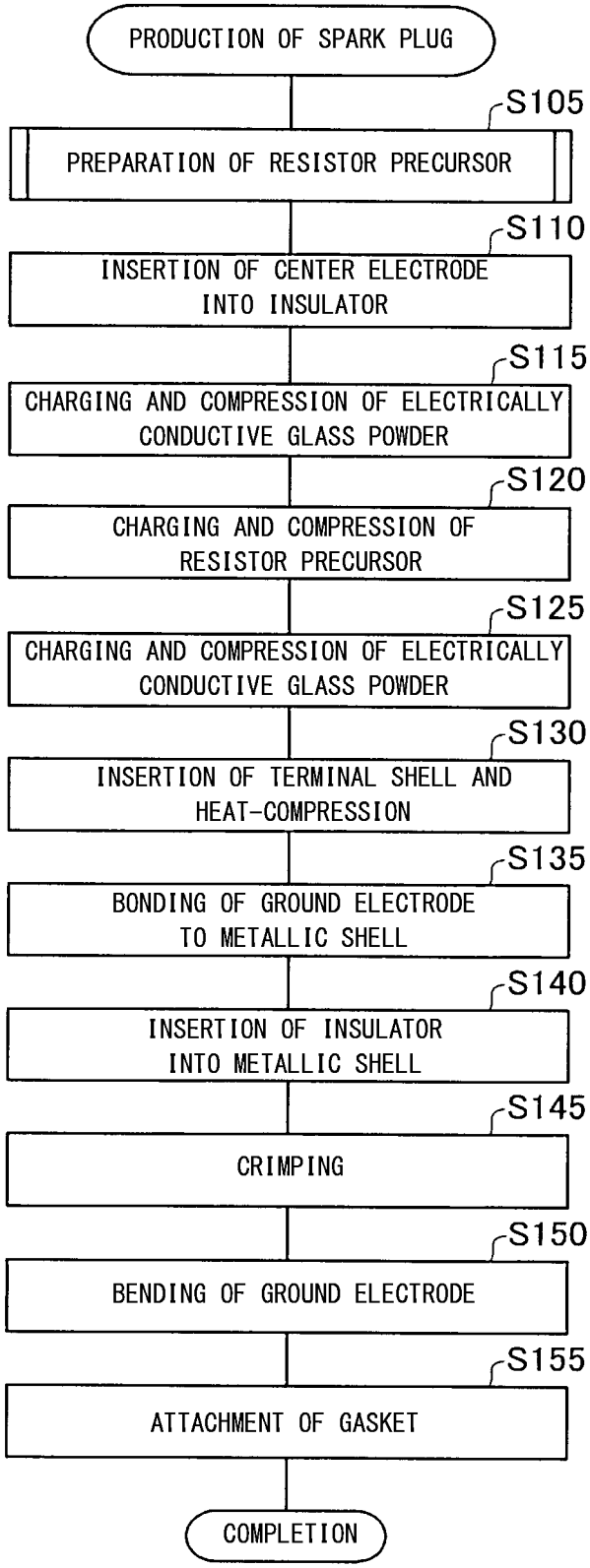
FIG. 2 is a flowchart showing production steps of the spark plug of the embodiment.
Figure 3:
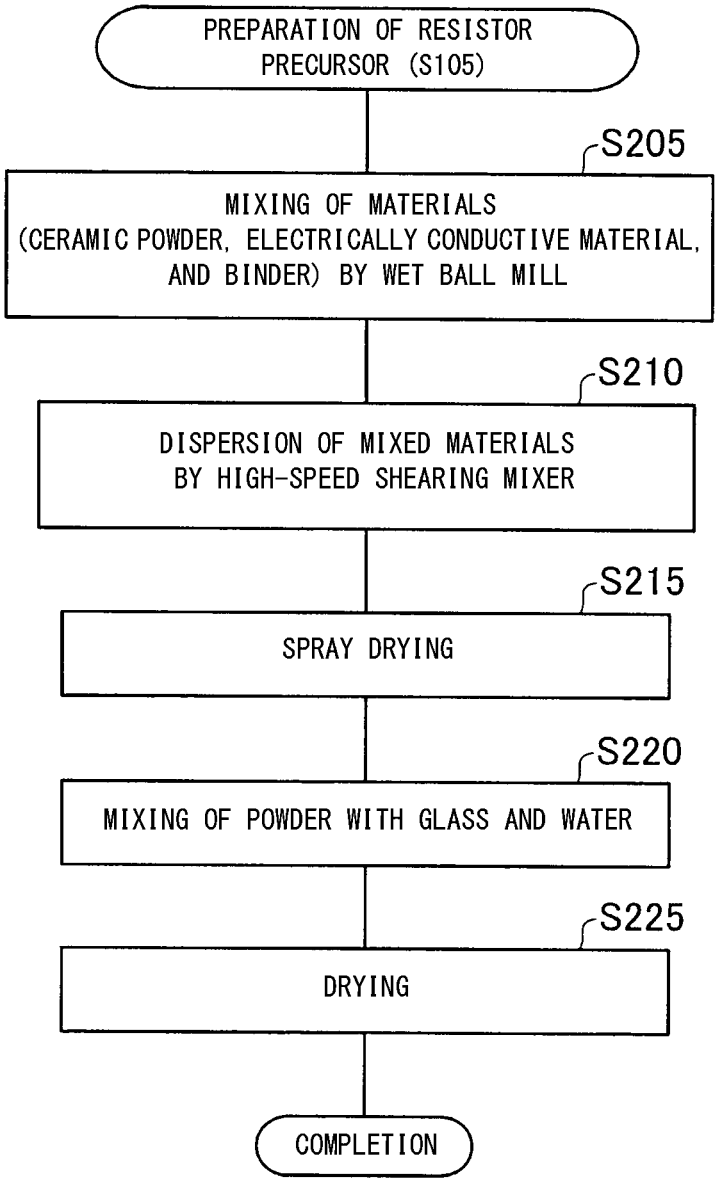
FIG. 3 is a flowchart showing preparation steps of a resistor precursor.

FIG. 2 is a flowchart showing production steps of the spark plug of the present embodiment. FIG. 3 is a flowchart showing preparation steps of the precursor of the resistor. As shown in FIG. 2, for production of the spark plug 100 of the present embodiment, firstly, the precursor of the resistor 15 is prepared (step S105). As shown in FIG. 3, for preparation of the precursor of the resistor 15, firstly, materials are mixed by means of a wet ball mill (step S205). In the present embodiment, the materials employed in step S205 correspond to ceramic powder, an electrically conductive material, and a binder. The ceramic powder employed may be, for example, ceramic powder containing $ZrO_2$ and $TiO_2$. The electrically conductive material employed may be, for example, carbon black. The binder (organic binder) employed may be, for example, a dispersant such as polycarboxylic acid. These materials are mixed with water (i.e., solvent) under stirring by means of a wet ball mill. Although the materials are mixed together, the degree of dispersion of the materials is relatively low.

Subsequently, the thus-mixed materials are dispersed by means of a high-speed shearing mixer (step S210). In the high-speed shearing mixer, the materials are mixed while being forcibly dispersed by means of a high shear force of a blade (stirring blade). The high-speed shearing mixer employed may be, for example, an axial mixer. Through mixing by means of the high-speed shearing mixer, the degree of dispersion of the materials is increased.

The material prepared through step S210 is granulated by spray drying (step S215). The powder prepared through step S215 is mixed with glass (coarse glass powder) and water (step S220), and the resultant mixture is dried (step S225), to thereby prepare the precursor of the resistor 15 (powdery precursor). The mixer employed for mixing in step S220 may be, for example, a universal mixer.

After completion of preparation of the precursor of the resistor 15, as shown in FIG. 2, the center electrode 3 is inserted into the through hole 6 of the insulator 2 (step S110). Electrically conductive glass powder is charged into the through hole 6 and compressed (step S115). This compression is realized by, for example, inserting a rod-like jig in the through hole 6, and pressing the deposited electrically conductive glass powder. A layer of the electrically conductive glass powder formed through step S115 becomes the electrically conductive glass sealing layer 16 shown in FIG. 1 through the below-described heat-compression step. The electrically conductive glass powder employed may be, for example, powder prepared by mixing copper powder with calcium borosilicate glass powder.

The precursor of the resistor 15 (powdery precursor) prepared through step S105 is charged into the through hole 6 and compressed (step S120), and then electrically conductive glass powder is charged into the through hole 6 and compressed (step S125). A layer of the powder formed through step S120 becomes the resistor 15 shown in FIG. 1 through the below-described heat-compression step. Similarly, a layer of the powder formed through step S125 becomes the electrically conductive glass sealing layer 17 shown in FIG. 1 through the below-described heat-compression step. The electrically conductive glass powder employed in step S125 may be the same as employed in step S115. The compression method employed in step S120 or S125 may be the same as employed in step S115.

A portion of the terminal shell 13 is inserted into the through hole 6, and a specific pressure is applied to the terminal shell 13 while the entirety of the insulator 2 is heated (step S130). Through this treatment, the respective materials charged into the through hole 6 are compressed and fired, to thereby form the electrically conductive glass sealing layers 16 and 17 and the resistor 15 in the through hole 6.

The ground electrode is bonded to the metallic shell 1 (step S135), and the insulator 2 is inserted into the metallic shell 1 (step S140), followed by crimping of the metallic shell 1 (step S145). Through the crimping step (step S145), the insulator 2 is fixed to the metallic shell 1. Subsequently, a tip end portion of the ground electrode bonded to the metallic shell 1 is bent (step S150), to thereby form the ground electrode 4 shown in FIG. 1. Thereafter, a non-illustrated gasket is attached to the metallic shell 1 (step S155), to thereby complete the spark plug 100.

B. Examples

B1. Example 1

In a manner similar to that described above in the embodiment, there were produced 10 spark plugs 100 (samples Nos. 1 to 10) each having a through hole 6 having a relatively small inner diameter (hereinafter may be referred to as "sealing diameter") of 3.2 mm. In Example 1, $ZrO_2$ powder was employed as ceramic powder; $TiO_2$ powder was employed as metal powder; and carbon black was employed as an electrically conductive material.

In each of samples Nos. 1 to 10 of Example 1, there were employed $TiO_2$ powder having a mean particle size of 0.6 μm and $ZrO_2$ powder having a mean particle size of 2.0 μm. In Example 1, for production of each sample (spark plug 100), the precursor of the resistor 15 was prepared by varying the amount of $TiO_2$ powder incorporated. Each of the thus-produced spark plugs 100 was evaluated in terms of load life performance, radio-noise-preventing property, and Ti dispersion state in a conduction path portion. Furthermore, each sample was comprehensively evaluated. In Example 1, the term "conduction path portion" refers to a region of the resistor 15, the region containing at least a Zr component and a Ti component, and forming a conduction path in the resistor 15. In addition to the aforementioned evaluations, the Zr content (wt. %) and Ti content (wt. %) of the conduction path portion of each spark plug 100 were determined.

Load life performance was evaluated as follows. Firstly, each of the above-produced spark plugs 100 was continuously subjected to a discharge test (3,600 discharges per minute through application of a discharge voltage of 20 kV at a temperature of 350° C.). Then, the resistance (R0) before the discharge test and the resistance (R1) after the discharge test were measured, and the average of the ratios of the resistance (R1) to the resistance (R0) (i.e., R1/R0) was determined every 10 consecutive cycles of the test. The period of time until the average of R1/R0 was 1.5 or more was determined. The longer the period of time, the higher the load life performance. Load life performance was evaluated according to the following criteria (i.e., score corresponding to the determined period of time):

shorter than 10 hours: 1
10 hours or longer and shorter than 20 hours: 2
20 hours or longer and shorter than 100 hours: 3
100 hours or longer and shorter than 120 hours: 4
120 hours or longer and shorter than 140 hours: 5
140 hours or longer: 5, +1 (every lapse of 20 hours).

Radio-noise-preventing property was evaluated as follows. Firstly, five samples (having almost the same resistance: 5±0.3 kΩ) corresponding to each of samples Nos. 1 to 10 were prepared. Subsequently, each sample was subjected to the radio noise evaluation test according to JASO D002-2, and the average of values corresponding to the radio-noise-preventing effect (i.e., radio-noise-preventing property) of each sample was determined. Among the thus-determined averages corresponding to the radio-noise-preventing effect, the radio-noise-preventing property at 65 MHz was employed for comparison. On the basis of the radio-noise-preventing property of sample No. 10 shown below in Table 1, score (1 to 10) was assigned to each sample according to the degree of improvement in radio-noise-preventing property. Specifically, score "1" was assigned to a sample in which the degree of improvement was less than 0.3 dB, and score "2" was assigned to a sample in which the degree of improvement was 0.3 dB or more and less than 0.5 dB. Thus, one-point-elevated score was assigned as the degree of improvement increased by 0.2 dB (e.g., score "5" was assigned to a sample in which the degree of improvement was 1.1 dB or more and less than 1.3 dB). Score "10" was assigned to a sample in which the degree of improvement was 2.1 dB or more. Rating "0" was assigned to a sample in which score was 5 or more; i.e., a sample exhibiting a high radio-noise-preventing effect, whereas rating "X" was assigned to a sample in which score was 4 or less; i.e., a sample exhibiting a low radio-noise-preventing effect.

For comprehensive evaluation of each spark plug 100, the lower of the score of load life performance and the score of radio-noise-preventing property was regarded as the score of comprehensive evaluation.

The Zr content and Ti content of a conduction path portion were determined as follows. Firstly, a sample of the resistor 15 was obtained from each of samples Nos. 1 to 10, and a cross section of the resistor sample was subjected to analysis by means of EPMA (electron probe micro analyzer), to thereby determine the Zr content and Ti content of a conduction path portion. Specifically, the Zr content and the Ti content were determined through WDS (wavelength dispersive X-ray spectrometry) by means of EPMA (acceleration voltage: 15 kV, irradiation current: $2.5\times10^{-8}$ A, effective time: 10 sec (high/low wavelength base: 5 sec), irradiation probe diameter: 10 μm, quantitative calculation: ZAF standard method, and standard sample employed: ASTIMEX (AS- TIMEC SCIENTIFIC LIMITED/Canada). For each sample, a circular region having a diameter of 20 μm was employed as an analysis region. For each sample, 30 analysis regions were selected in a conduction path portion. The Zr or Ti content of each analysis region was measured, and the average of the Zr or Ti contents of the 30 analysis regions was determined.

FIG. 4 is an explanatory view of an example of a sample employed for Zr or Ti content determination by means of EPMA. The upper part of FIG. 4 corresponds to an image F1 of a portion of the sample as taken during Zr or Ti content determination by means of EPMA, and the lower part of FIG. 4 corresponds to an image F1*a* schematically showing the image F1.

As shown in the image F1*a*, the resistor 15 includes glass portions Ar2 serving as a skeleton, and a conductive path region Ar1 sandwiched between the glass portions Ar2. As shown in the image F1, the conductive path region Ar1 contains fine white grains. These fine grains correspond to $ZrO_2$ grains. The conductive path region Ar1 contains $ZrO_2$ grains, $TiO_2$ grains, carbon grains, and melted glass. In the conductive path region Ar1, electrical conductivity is secured by means of carbon.

In the conductive path region Ar1 shown in the image F1*a*, a total of 10 analysis regions; i.e., f1, f2, f3, f4, f5, f11, f12, f13, f14, and f15, are selected. Among these regions, five analysis regions f1 to f5 are continuously located. Similarly, five analysis regions f11 to f15 are continuously located. Although a total of 10 analysis regions are selected in FIG. 4, as described above, a total of 30 analysis regions are selected in each sample.

The Ti dispersion state in the conduction path portion was evaluated as follows. In the case where the average of the Ti contents of 30 analysis regions of each sample was represented by A, and the Ti content of each analysis region was represented by B, when "the number of regions in which B was less than 0.25×A or 3.0×A or more" was large (i.e., 3 or more), the dispersibility of Ti was evaluated as being low, whereas when the number of such regions was small (i.e., 2 or less), the dispersibility of Ti was evaluated as being high (good). The reason for this evaluation is based on the assumption that when the dispersibility of Ti is high, B becomes nearly equal to A, since the amounts of Ti contained in the respective analysis regions are nearly equal to one another; i.e., when the dispersibility of Ti is high, there is neither a region in which B is less than 0.25×A, nor a region in which B is 3.0×A or more.

Table 1 (see FIG. 5) shows the results of measurement and evaluation of the respective spark plugs 100 of Example 1. In Table 1, "Amount of $TiO_2$ having a particle size of 1 μm or less" corresponds to the amount (wt. %) of $TiO_2$ contained in the entire precursor of the resistor 15 and having a particle size of 1 μm or less. This value was calculated on the basis of the amount of $TiO_2$ powder employed in the precursor of the resistor 15, and also the amount of $TiO_2$ powder having a particle size of 1 μm or less, which was determined by means of the particle size distribution profile of the employed $TiO_2$ powder. The radio-noise-preventing property of each sample was determined on the basis of that of sample No. 10.

As shown in Table 1, in all the samples Nos. 1 to 10, Ti dispersion state was evaluated as good (O). In this case, the Ti content of five continuous analysis regions (e.g., the analysis regions f1 to f5 or analysis regions f11 to f15 shown in FIG. 4) was found to be 0.5 wt. % to 15 wt. %.

As shown in Table 1, a sample in which the Ti content was 0.5 wt. % to 15 wt. % exhibited a comprehensive evaluation score as high as 8 or more. Particularly, each of samples Nos. 3 to 8, in which the Ti content was 1.0 wt. % to 12 wt. %, exhibited a comprehensive evaluation score of 9 or more, a load life performance score of 10, and a radio-noise-preventing property score of 9 or more. In contrast, sample No. 1, in which the Ti content was 0.2 wt. %, or sample No. 10, in which the Ti content was 18 wt. %, exhibited a comprehensive evaluation score as low as 3 or less.

Conceivably, the reason why the load life performance score of sample No. 1 was as low as 3 is as follows. In a conduction path portion, since Zr, which has insulation property, is present around carbon (i.e., electrically conductive material), contact resistance is generated. In a high voltage environment (20 kV), the carbon is heated due to the thus-generated contact resistance, and the thus-heated carbon reacts with glass in the vicinity thereof, resulting in degradation of the carbon. Specifically, the carbon is removed through oxidation. Since $TiO_2$ has a relatively low electrical resistance, and exhibits high electrical conductivity particularly in a high voltage environment (20 kV), current is likely to flow through $TiO_2$ in the conduction path portion. Therefore, through incorporation of $TiO_2$, the electrical resistance of the entirety of the resistor 15 can be reduced, and the aforementioned carbon degradation due to contact resistance can be suppressed. However, when the $TiO_2$ content of the conduction path portion is low as in the case of sample No. 1, electrical resistance increases in association with a small amount of $TiO_2$. In addition, when the $TiO_2$ content of the conduction path portion is low, carbon degradation may fail to be sufficiently suppressed, and thus the amount of carbon is reduced. A reduction in amount of carbon causes an increase in electrical resistance. Therefore, the electrical resistance of the entirety of the resistor 15 increases, and thus electrical conductivity is lowered, leading to poor ignition performance. Conceivably, this results in deterioration of load life performance.

Conceivably, the reason why the radio-noise-preventing property score of sample No. 10 was as low as 1 is as follows. Since the conduction path portion contains a large amount of $TiO_2$ (Ti content: 18%), the electrical resistance of the entirety of the resistor 15 is lowered. Samples Nos. 1 and 10 (spark plugs 100) do not correspond to the spark plug as described in the claims.

Table 2 (see FIG. 6) shows the results of measurement and evaluation of spark plugs of Comparative Example. Since the items shown in Table 2 are the same as those shown in Table 1, description thereof is omitted. For production of each of the samples of the Comparative Example (samples Nos. 58, 59, and 60), the aforementioned treatment of step S210 (i.e., dispersion treatment of the materials of the resistor 15 by means of a high-speed shearing mixer) was omitted. The types of the materials of the resistor 15, and the spark plug production procedure were the same as in the case of each spark plug 100 in Example 1. The amounts of the respective materials of the resistor 15 of sample No. 58 were the same as those of the respective materials of the resistor 15 of sample No. 5 in Example 1. Therefore, as shown in Tables 1 and 2, the Zr content and Ti content of sample No. 58 were the same as those of sample No. 5. Also, the amounts of the respective materials of the resistor 15 of sample No. 59 were the same as those of the respective materials of the resistor 15 of sample No. 9 in Example 1. Therefore, as shown in Tables 1 and 2, the Zr content and Ti content of sample No. 59 were the same as those of sample No. 9. Also, the amounts of the respective materials of the resistor 15 of sample No. 60 were the same as those of the respective materials of the resistor 15 of sample No. 10 in Example 1. Therefore, as shown in Tables 1 and 2, the Zr content and Ti content of sample No. 60 were the same as those of sample No. 10.

As shown in Table 2, in the samples of the Comparative Example (samples Nos. 58 to 60), Ti dispersion state was evaluated as poor; i.e., the respective materials were present in an aggregate form in the resistor 15. Each of samples Nos. 58 to 60 of the Comparative Example exhibited a load life performance score as low as 5 or less. Although samples Nos. 5, 9, and 10 exhibited a high load life performance score (10 for each) as shown in Table 1, the corresponding samples Nos. 58, 59, and 60 exhibited a low load life performance score (1, 1, and 5, respectively). A conceivable reason for this is as follows. In samples Nos. 58 to 60, $TiO_2$ is present in an aggregate form in a conduction path portion of the resistor 15, and thus the number of carbon grains around which no $TiO_2$ is present is increased. Particularly, $TiO_2$ has a mean particle size smaller than that of another material, and thus is likely to be aggregated. Therefore, when the vigorous dispersion treatment (step S210) is omitted, the number of carbon grains around which no $TiO_2$ is present is increased. Since there is no current-flowing path in the vicinity of carbon grains around which no $TiO_2$ is present, carbon degradation is likely to occur due to contact resistance, resulting in local removal of carbon. Conceivably, this increases the electrical resistance of the entirety of the resistor 15, and causes deterioration of ignition performance (load life performance). The radio-noise-preventing properties of samples Nos. 58, 59, and 60 were similar to those of samples Nos. 5, 9, and 10.

In each of samples Nos. 58 to 60, in which Ti dispersibility is low, the Ti content of any of five continuous analysis regions (as shown in FIG. 4) is considered to fall outside a range of 0.5 wt. % to 15 wt. %.

As described above, in view of the experimental results shown in Tables 1 and 2, preferably, the Ti content of a conduction path portion of the resistor 15 is 0.5 wt. % to 15 wt. %, and Ti is sufficiently dispersed in the conduction path portion. As used herein, the expression "sufficiently dispersed" refers to the case where the average of the Ti contents of five continuous circular regions, each region having a diameter of 20 μm, is 0.5 wt. % to 15 wt. %.

C. Example 2

In a manner similar to that described above in the embodiment, seven spark plugs 100 (samples Nos. 11 to 17) were produced. In Example 2, the spark plugs 100 were produced by use of $ZrO_2$ powders and $TiO_2$ powders having different mean particle sizes. Specifically, for production of the spark plugs 100, the Ti content of the resistor 15 was adjusted to be constant in the respective samples Nos. 11 to 17, and a plurality of $ZrO_2$ powders and a plurality of $TiO_2$ powders having different mean particle sizes were mixed in different proportions. The types of raw materials employed and sealing diameter were the same as those in Example 1.

In a manner similar to that described in Example 1, each of the thus-produced spark plugs 100 was evaluated in terms of Ti dispersion state, load life performance, and radio-noise-preventing property, and each sample was comprehensively evaluated. Also, Zr content and Ti content were determined in a manner similar to that described in Example 1. Since evaluation methods and Zr or Ti content determination method employed are the same as those in Example 1, description thereof is omitted.

Table 3 (see FIG. 7) shows the results of measurement and evaluation of the spark plugs 100 of Example 2. Since the items shown in Table 3 are the same as those shown in Table 1, description thereof is omitted. As shown in Table 3, in Example 2, the Ti content of the resistor 15 was adjusted to 8 wt. % in each of samples Nos. 11 to 17.

As shown in Table 3, Zr content was almost the same and Ti content was the same between samples Nos. 11 and 15, but $TiO_2$ mean particle size greatly differed between samples Nos. 11 and 15. Sample No. 11 exhibited a load life performance score of "6," but sample No. 15 exhibited a load life performance score of "10." A conceivable reason for the difference in load life performance between samples Nos. 11 and 15 is as follows. Although Ti content is the same between samples Nos. 11 and 15, $TiO_2$ mean particle size in sample No. 15 is smaller than that in sample No. 11. Therefore, in sample No. 15, the number of $TiO_2$ grains contained in the resistor 15 is larger, as compared with the case of sample No. 11. That is, the number of carbon grains around which no $TiO_2$ is present is relatively small, and thus carbon degradation, which is due to the aforementioned contact resistance, can be suppressed in many carbon grains. In contrast, in sample No. 11, the number of $TiO_2$ grains contained in the resistor 15 is smaller, as compared with the case of sample No. 15, and thus the number of carbon grains around which no $TiO_2$ is present is relatively large. Therefore, in sample No. 11, carbon degradation, which is due to the aforementioned contact resistance, is more likely to occur, as compared with sample No. 15. Conceivably, the difference in load life performance between samples Nos. 11 and 15 is based on the aforementioned reason.

Also, as shown in Table 3, Ti content was the same between samples Nos. 11 and 13, but $TiO_2$ mean particle size in sample No. 13 was larger than that in sample No. 11. Therefore, the number of $TiO_2$ grains contained in the resistor 15 was relatively small in sample No. 13. However, as shown in Table 3, the load life performance of sample No. 13 was higher than that of sample No. 11. A conceivable reason for this is as follows. Since carbon grains are present around $ZrO_2$ grains, when $ZrO_2$ powder having a large mean particle size is employed, carbon grains present around large $ZrO_2$ grains are greatly separated from one another. Therefore, since carbon grains are relatively dispersed in the resistor, the number of carbon grains around which no $TiO_2$ grains are present is relatively small, and the load life performance of sample No. 13 is higher than that of sample No. 11.

As shown in Table 3, each of samples Nos. 11, 12, and 14 exhibited a load life performance score of "6," which was lower than the load life performance score "10" of each of the other samples (samples Nos. 13 and 15 to 17). On the basis of the aforementioned comparison between samples Nos. 11 and 15 or between samples Nos. 11 and 13, a conceivable reason for this difference in load life performance is as follows. In sample No. 14, there is no difference in mean particle size between $TiO_2$ and $ZrO_2$. When there is no or little difference in mean particle size between $TiO_2$ and $ZrO_2$, the dispersibility of $TiO_2$ grains relative to carbon grains becomes low. Therefore, conceivably, the number of carbon grains around which no $TiO_2$ is present is increased, and load life performance is deteriorated. In sample No. 11 or 12, since the mean particle size of $TiO_2$ is larger than that of $ZrO_2$, the number of carbon grains around which no $TiO_2$ is present may be increased, as compared with the case where the mean particle size of $TiO_2$ is smaller that of $ZrO_2$. This is a conceivable reason for deterioration of load life performance. Meanwhile, in each of samples Nos. 13 and 15 to 17, the mean particle size of $TiO_2$ is smaller by 0.2 μm or more than that of $ZrO_2$.

As described above, in view of the experimental results shown in Table 3, preferably, the mean particle size of $TiO_2$ particles is smaller by 0.2 μm or more than that of $ZrO_2$ particles.

In all the samples Nos. 11 to 17, Ti dispersion state was evaluated as good (O). These samples Nos. 11 and 17 (spark plugs 100) correspond to the spark plug as described in the claims.

D. Example 3

In a manner similar to that described above in the embodiment, 32 spark plugs 100 (samples Nos. 18 to 49) were produced. In Example 3, for production of spark plugs 100, sealing diameter was varied, and the amount of $TiO_2$ powder incorporated into the precursor of the resistor 15 was varied. Specifically, as shown in Table 4, spark plugs 100 of four groups having different sealing diameters were produced. In the samples of group 1 (samples Nos. 18 to 25), sealing diameter was adjusted to 2.5 mm. In the samples of group 2 (samples Nos. 26 to 33), sealing diameter was adjusted to 2.9 mm. In the samples of group 3 (samples Nos. 34 to 41), sealing diameter was adjusted to 3.5 mm. In the samples of group 4 (samples Nos. 42 to 49), sealing diameter was adjusted to 4.0 mm. In Example 3, for production of eight samples (spark plugs 100) of each group having different Ti contents, the precursor of the resistor 15 was prepared by varying the amount of $TiO_2$ powder incorporated as in the case of Example 1. For production of the respective samples Nos. 18 to 49 of Example 3, the types of raw materials employed were the same as those in Example 1. The mean particle sizes of $TiO_2$ powder and $ZrO_2$ powder employed in Example 3 were the same as those in Example 1.

In a manner similar to that described in Example 1, each of the thus-produced spark plugs 100 was evaluated in terms of Ti dispersion state, load life performance, and radio-noise-preventing property, and each sample was comprehensively evaluated. Also, Zr content and Ti content were determined in a manner similar to that described in Example 1. Since evaluation methods and Zr or Ti content determination method employed are the same as those in Example 1, description thereof is omitted.

Table 4 (see FIG. 8) shows the results of measurement and evaluation of the spark plugs 100 of Example 3. Since the items shown in Table 4 are the same as those shown in Table 1, description thereof is omitted. Similar to the results obtained in Example 1, samples Nos. 18, 26, 34, and 42 (Ti content: less than 0.5 wt. %) and samples 25, 33, 41, and 49 (Ti content: more than 15 wt. %) of the respective groups exhibited a comprehensive evaluation score as low as 4 or less. These samples (i.e., samples Nos. 18, 25, 26, 33, 34, 41, 42, and 49) do not correspond to the spark plug as described in the claims.

The load life performance scores of sample No. 42 (Ti content: 0.2 wt. %) and sample No. 43 (Ti content: 0.5 wt. %) of group 4 were 4 and 8, respectively; i.e., the difference in load life performance score between these two samples was "4." The load life performance scores of sample Nos. 34 and 35 of group 3 (Ti contents were the same as samples Nos. 42 and No. 43, respectively) were 3 and 8, respectively; i.e., the difference in load life performance score between these two samples was "5." The load life performance scores of sample Nos. 26 and 27 of group 2 (Ti contents were the same as samples Nos. 42 and No. 43, respectively) were 1 and 8, respectively; i.e., the difference in load life performance score between these two samples was "7." The load life performance scores of sample Nos. 18 and 19 of group 1 (Ti contents were the same as samples Nos. 42 and No. 43, respectively) were 1 and 8, respectively; i.e., the difference in load life performance score between these two samples was "7." As is clear from these data, in the case of samples having a sealing diameter of 3.5 mm or less, the difference in load life performance score between a sample (Ti content: 0.5 wt. %) and a sample (Ti content: 0.2 wt. %) is 5 or more; i.e., the degree of improvement in load life performance is increased in association with an increase in Ti content. Particularly in the case of samples having a sealing diameter of 2.9 mm or less, the degree of improvement in load life performance is more increased (difference in load life performance score: 7). Thus, as is clear from these data, when the sealing diameter is 3.5 mm or less (preferably 2.9 mm or less), incorporation of an appropriate amount of Ti achieves a higher effect of improving load life performance.

As described above, in a sample having a relatively small sealing diameter, incorporation of an appropriate amount of Ti achieves a high effect of improving load life performance. A conceivable reason for this is as follows. In the step of compressing the precursor of the resistor 15 (step S120) shown in FIG. 2, when the entire precursor is excessively soft, pressure is difficult to transmit from the pressing surface of the precursor toward a lower portion thereof, and difficulty is encountered in compressing the precursor. In contrast, when the entire precursor is excessively hard, only a portion of the precursor in the vicinity of the pressing surface may be compressed, and a lower portion of the precursor may fail to be compressed. Generally, compression is difficult to carry out in a sample having a relatively small sealing diameter. However, in the case where the Ti content of a resistor precursor is relatively high, since the precursor has an appropriate hardness, compression is easy to carry out even in a sample having a relatively small sealing diameter. Therefore, conceivably, the precursor exhibits high density, and thus the number of carbon grains around which Ti is present can be increased, whereby the sample exhibits greatly improved load life performance. Meanwhile, since compression is generally easy to carry out in a sample having a relatively large sealing diameter, the degree of improvement in compressibility, which is associated with an increase in Ti content of a resistor precursor, is lower in the sample, as compared with the case of a sample having a small sealing diameter. Therefore, conceivably, the effect of improving load life performance in a sample having a large sealing diameter is lower than that in a sample having a small sealing diameter.

As described above, in view of the experimental results shown in Table 4, when Ti content is increased within an appropriate range (i.e., 0.5 wt. % to 15 wt. %) in a spark plug 100 having a sealing diameter of 3.5 mm or less (more preferably 2.9 mm or less), the spark plug exhibits greatly improved load life performance.

E: Example 4

In a manner similar to that described above in the embodiment, eight spark plugs 100 (samples Nos. 50 to 57) were produced. In Example 4, the spark plugs 100 were produced by use of $TiO_2$ powders having different mean particle sizes. Specifically, for production of samples Nos. 50 to 57, the Ti content of the resistor 15 was adjusted to be constant (5 wt. %) in the eight spark plugs, and a plurality of $TiO_2$ powders having different mean particle sizes were mixed in different proportions. Unlike the case of Example 2, only a single type of $ZrO_2$ powder was employed. The types of raw materials employed and sealing diameter were the same as those in Example 1.

In a manner similar to that described in Example 1, each of the thus-produced samples Nos. 50 to 57 was evaluated in terms of Ti dispersion state, load life performance, and radio-noise-preventing property, and each sample was comprehensively evaluated. Also, Zr content and Ti content were determined in a manner similar to that described in Example 1. Since evaluation methods and Zr or Ti content determination method employed are the same as those in Example 1, description thereof is omitted.

Table 5 (see FIG. 9) shows the results of measurement and evaluation of the spark plugs 100 of Example 4. Since the items shown in Table 5 are the same as those shown in Table 1, description thereof is omitted. As shown in Table 5, in Example 4, "$TiO_2$ mean particle sizes" and "amounts of $TiO_2$ having a particle size of 1 μm or less" are different from one another in the respective samples Nos. 50 to 57. Each of samples Nos. 50 to 57 corresponds to the spark plug as described in the claims.

As shown in Table 5, each of samples Nos. 51 to 56, in which the "amount of $TiO_2$ having a particle size of 1 μm or less" contained in the entire precursor of the resistor 15 was 0.10 wt. % to 4.00 wt. %, exhibited a load life performance score of 10. In contrast, sample No. 50, in which the "amount of $TiO_2$ having a particle size of 1 μm or less" was 0.05 wt. %, or sample No. 57, in which the "amount of $TiO_2$ having a particle size of 1 μm or less" was 4.50 wt. %, exhibited a load life performance score of 9, which was lower than that of each of samples Nos. 51 to 56. When the amount of $TiO_2$ having a particle size of 1 μm or less is small, the number of $TiO_2$ grains is relatively reduced, and the number of carbon grains around which no $TiO_2$ is present is relatively increased. Therefore, sample No. 50 is considered to exhibit low load life performance. In contrast, when the amount of $TiO_2$ having a particle size of 1 μm or less is excessively large, since particles having a small particle size are likely to be aggregated together, the dispersibility of $TiO_2$ grains is lowered, and thus the number of carbon grains around which no $TiO_2$ is present is increased. Therefore, sample No. 57 is considered to exhibit low load life performance.

As described above, in view of the experimental results shown in Table 5, when the amount of $TiO_2$ having a particle size of 1 μm or less contained in the entire precursor of the resistor 15 is 0.10 wt. % to 4.00 wt. %, load life performance can be improved.

F. Modification

Modification 1:

As described above in the embodiment and examples, in a sample exhibiting good Ti dispersibility, the average of the Ti contents of five continuous analysis regions is 0.5 wt. % to 15 wt. %. However, the present invention is not limited to the case where the average of the Ti contents of "five continuous analysis regions" is 0.5 wt. % to 15 wt. %. Conceivably, in a sample exhibiting good Ti dispersibility, the average of the Ti contents of any plurality of partial regions of a conduction path portion is 0.5 wt. % to 15 wt. %. Thus, the "five continuous analysis regions" described in the examples is an example of the aforementioned plurality of partial regions.

The present invention is not limited to the above-described embodiment, examples, and modification, and various modifications may be made without departing from the scope of the present invention. For example, the technical characteristics described in the embodiment, examples, and modification corresponding to those of the modes described in the section "Summary of the Invention" may be appropriately replaced or combined in order to partially or completely solve the aforementioned problems, or to partially or completely achieve the aforementioned effects. Unless the technical characteristics are described as essential ones in the present specification, they may be appropriately omitted.

DESCRIPTION OF REFERENCE NUMERALS

1: metallic shell
2: insulator
3: center electrode
4: ground electrode
6: through hole
13: terminal shell
15: resistor
16: electrically conductive glass sealing layer
17: electrically conductive glass sealing layer
31: ignition portion
32: side surface
100: spark plug
O: axis
F1: image
F1*a*: image
f1 to f5, f11 to f15: analysis region
Ar1: conductive path region
Ar2: glass portion

The invention claimed is:

1. A spark plug comprising:

a circular columnar insulator having a through hole extending in an axial direction;

a center electrode fixed in the through hole of the insulator;

a terminal shell fixed in the through hole of the insulator; and a resistor which is provided in the through hole and between the terminal shell and the center electrode, and which contains glass, a Ti component, a Zr component, and a non-metallic electrically conductive material, wherein:

in a cross section of a conduction path portion of the resistor, the conduction path portion containing the Zr component and the Ti component, the average of the Ti component contents by weight of five continuous circular regions, each region having a diameter of 20 μm, is 0.5 wt. % to 15 wt. %, wherein the Zr component content by weight of the conduction path portion is 10 wt. % to 40 wt. %; and when A represents the average of the Ti component contents by weight of any 30 circular regions, each region having a diameter of 20 μm, in the conduction path portion, and when B represents the Ti component content by weight of each of the 30 circular regions, the total of the number of circular regions in which B is less than 0.25 times A and the number of circular regions in which B is greater than 3.0 times A is 2 or less; and wherein the resistor is produced from at least $TiO_2$ particles and $ZrO_2$ particles, and the $TiO_2$ particles have a mean particle size smaller by 0.2 μm or more than that of the $ZrO_2$ particles.

2. A spark plug according to claim 1, wherein the Ti component content by weight is 1.0 wt. % to 12 wt. %.

3. A spark plug according to claim 1, wherein a portion of the through hole where the resistor is provided has a minimum diameter of 3.5 mm or less.

4. A spark plug according to claim 3, wherein a portion of the through hole where the resistor is provided has a minimum diameter of 2.9 mm or less.

5. A spark plug according to claim 1, wherein, in a material of the resistor, the amount by weight of $TiO_2$ particles having a particle size of 1 μm or less is 0.1 wt. % to 4.0 wt. %.

* * * * *